United States Patent [19]

Wolff et al.

[11] Patent Number: 4,583,921

[45] Date of Patent: Apr. 22, 1986

[54] PLUNGER PUMP

[75] Inventors: Horst Wolff; Franz Hani, both of Geretsried, Fed. Rep. of Germany

[73] Assignee: Speck-Kolbenpumpen-Fabrik Otto Speck KG, Fed. Rep. of Germany

[21] Appl. No.: 687,615

[22] Filed: Dec. 28, 1984

[30] Foreign Application Priority Data

Dec. 28, 1983 [DE] Fed. Rep. of Germany ..... 3347307

[51] Int. Cl.[4] ..... F04B 1/18; F04B 39/02; F01B 31/10

[52] U.S. Cl. ..... 417/269; 417/539; 92/86.5

[58] Field of Search ..... 417/269, 271, 439, 539, 417/270; 92/156, 86.5, 128; 184/6.25

[56] References Cited

U.S. PATENT DOCUMENTS

| | | | |
|---|---|---|---|
| 2,188,035 | 1/1940 | Dauster | 417/269 |
| 2,622,942 | 12/1952 | Munoz | 184/6.25 |
| 2,712,829 | 7/1955 | Bracham | 417/269 |
| 3,018,737 | 1/1962 | Cook et al. | 92/86.5 |
| 3,151,703 | 10/1964 | Benk | 184/6.25 |
| 3,175,545 | 3/1965 | Barfod | 417/269 |
| 3,292,554 | 12/1966 | Hessler | 417/269 |
| 3,507,584 | 4/1970 | Robbins, Jr. | 417/439 |
| 3,811,798 | 5/1974 | Bickford | 92/156 |
| 3,849,032 | 11/1974 | Mulvey | 92/156 |
| 3,992,133 | 11/1976 | Brunner | 417/366 |
| 4,093,240 | 6/1978 | Masada | 417/568 |
| 4,140,443 | 2,1979 | Mulvey | 92/156 |
| 4,456,439 | 6/1984 | Wolff | 417/539 |

FOREIGN PATENT DOCUMENTS

| | | | |
|---|---|---|---|
| 48401 | 1/1984 | Japan | 417/269 |

*Primary Examiner*—William L. Freeh

*Attorney, Agent, or Firm*—Townsend and Townsend

[57] ABSTRACT

A pump which operates with several plungers is described with the plunger preferably being actuated via an eccentric drive unit and, having regard to the particular volume of flow per unit time, using several small plungers rather than a lesser number of comparatively large plungers, and accordingly operating with a large number of small volume displacements at a comparatively high speed of rotation. In this arrangement the suction chamber is centrally arranged in the pump body and the high pressure outlets of the pump chambers, which open into a common pressure chamber of ring-like construction, extend at least substantially in a radial direction.

19 Claims, 2 Drawing Figures

PLUNGER PUMP

Figure 1:
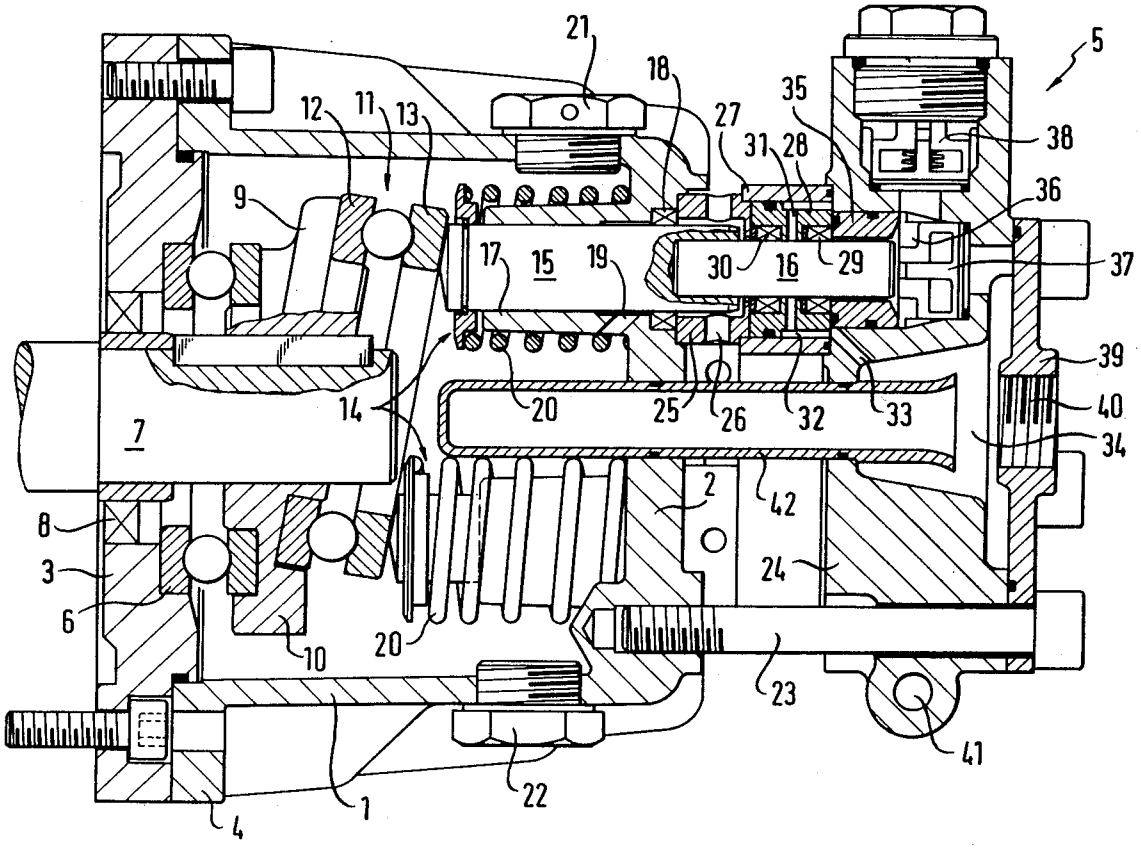

The invention relates to a pump which operates with a plurality of plungers, with the plungers being symmetrically arranged relative to the centre of the drive shaft.

It is characteristic of pumps of this kind that the medium to be forwarded by the pump is supplied separated from the drive side which has to be lubricated.

This separation of the medium to be pumped and the lubricant brings the advantage that such pumps can also be used in technical fields in which special media have to be pumped and in which a consequential separation from the lubricating oil circuits is absolutely essential.

The principle object underlying the present invention is to provide a pump which operates with a plurality of plungers, in particular with five plungers, which has a particularly compact construction, which provides an extremely uniform pump output, which ensures quiet vibration free running and which can be manufactured very economically.

In order to satisfy this object there is provided, in accordance with the invention, a plunger pump comprising a plurality of plungers which are guided with their axes parallel to a drive shaft in sleeves fixed relative to a housing and which are actuated via an eccentric drive unit, and a pump chamber arrangement, characterised in that the plungers and the pump chambers associated therewith are arranged directly adjacent to one another and concentric to the drive shaft, and also to a suction chamber centrally disposed in the pump body; and in that the high pressure outlets of the pump chambers which open into a common annular pressure chamber extend at least substantially radially.

With this arrangement it is of particular significance that, having regard to the rate of delivery, several small plungers are used instead of a smaller number of comparatively larger plungers, and that the pump operates at a comparatively high speed of rotation with a large number of small volumes of the pumped medium being displaced per unit time, which results not only in very uniform delivery and surprisingly quiet vibration free running, but also in the load which occur at the drive side being ideally distributed, which makes possible the use of cost effective drive members.

When using a swash plate drive for the individual plungers which are arranged with their axes parallel to the drive shaft, and which are preferably biased against the swash plate by spring force, it is of advantage to use a simple ball bearing in place of the needle bearing which is normally used with swash plate drives, which leads to a substantial cost saving.

With this arrangement the pump-side edge of the ball bearing which belongs to the swash plate serves to actuate the plungers directly. The rolling off processes which occur in operation between the plungers and the ring of the ball bearing lead to smoothing and hardening effects which improve the operation and the operating life in the desired manner.

The paths taken by the medium to be forwarded is of particular significance in order to avoid cavitation problems, particularly when pumping warm water. In this respect the provision of a centrally arranged suction connection which is combined with a coarse filter is particularly advantageous because in this manner very short and favourable flow paths to the inlet (suction) valves can be provided. The layout of the peripherally extending pressure chamber, which lies approximately in the plane of the pump chamber and which consists of straight passage sections which extend between the outlet (pressure) valve regions, and which can be simply manufactured by a boring procedure, is of constructional importance.

A further important advantage of the use of a centrally disposed suction connection lies in the fact that leakages can be simply returned into the region of the suction connection via short connecting bores.

All suction valves have the same spacing from the suction connection which has particularly favourable effects from the point of view of the flow in conjunction with the short paths.

A further special feature of the invention, which is also particularly favourable from a functional point of view and having regard to the endeavour to produce an economical construction as a whole, lies in the fact that two part plungers are used with the drive side part of the plunger having a larger diameter than pump side part of the plunger. In this manner one can obtain ideal guide surfaces for the plunger at the drive side and ideal displacement strokes at the pump side.

In a preferred embodiment of the plunger the front or pumpside part of the plunger consists of a solid ceramic body which is connected and in particular adhered to the rear metallic part. The adhesive bonding is preferably effected at a temperature below the operating temperature which normally mounts to 80° C., whereas a temperature which substantially corresponds to the operating temperature is chosen as the adhesive curing temperature.

In accordance with a further special feature of the invention a cooling device is provided in the free space between the plungers which extend into the drive chamber. The cooling device is in itself of closed construction and is acted on by the particular medium which is to be forwarded.

This cooling device preferably consists of a tube which extends from the region of the suction connection into the area of the swash plate with a part of the medium to be forwarded flowing through this tube. In this manner it is possible to use the medium which is pumped for dissipating heat despite the exact separation of the drive zone which is to be lubricated and the pumping zone.

In accordance with a further embodiment of the invention the plungers can also be radially disposed so that their axes do not extend parallel to the drive shaft but instead perpendicular thereto. In this embodiment it is also important that a plurality of comparatively small plungers are used in conjunction with a higher speed of rotation of the drive, because all embodiments of the invention retain the principle that one operates with small ideally distributed forces, because only in this manner is it possible to achieve the advantages indicated above and also to use high speeds of rotation without a disturbing increase in temperature. An important advantage of the radial embodiment is the fact that the pump can be made very compact and, when connected by a flange to the drive motor lies within the external contour of the particular motor, so that in total a very compact Motor/pump unit can always be provided.

Figure 2:
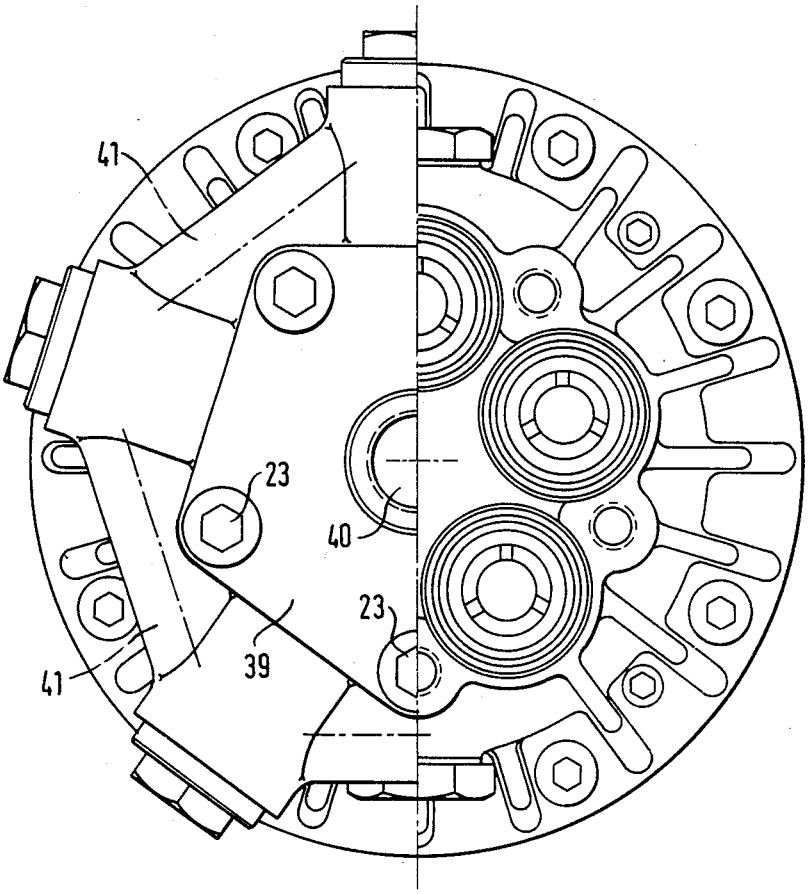

An embodiment of the invention will now be described in the following with reference to the drawings, which show:

FIG. 1 a schematic partly sectioned and also broken away view of a pump in accordance with the invention which operates with five plungers, and FIG. 2 an end view of the pump of FIG. 1 with half of the pump being cut away to illustrate the plunger arrangement.

As seen in FIG. 1 a drive housing 1 which is of substantially pot-like shape is provided, with the base part 2 of the drive housing having openings for plungers and forming a mounting surface for the actual pump aggregate 5.

At the side facing the actual drive motor the housing 1 is closed by a stable terminal wall 3 which preferably consists of a thermally poorly conducting material so that the heat of the drive motor is kept away from the housing 1 as far as possible.

The housing 1 and the terminal wall 3 are connected together by screws. Furthermore, bores for threaded bolts are provided in the area of the flange-like end 4 of the housing, by means of which the entire pump unit can be fastened to a drive motor.

The circular periphery of the pump is preferably the same as or smaller than the peripheral circle of the associated motor. Furthermore, it is favourable to lay out the connections so that the pump can be secured to standard (normed) motors.

A thrust bearing 6 is mounted in the end wall 3 and a seal 8 is provided between the end wall 3 and the motor shaft 7. The drive shaft 7 is keyed to a swash plate 9 which is provided with a balance weight 10 in the normal manner. The swash plate 9, which can consist of a sintered or forged part, carries a ball bearing 11 of which one ring 12 is connected with the swash plate 9 whereas the other ring 13 cooperates with the plungers 14.

Whereas the ring 12 rotates at the speed of rotation of the motor the ring 13 substantially only executes a rolling off movement relative to the plungers 14.

It should be pointed out that the ball bearing 11 is a commercial and thus inexpensive ball bearing.

The rolling-off effect which occurs between the bearing ring 13 and the plungers 14 results in the bearing ring 13 being smoothed, i.e. even rough bearing rings become smooth and hardened after a short period of operation, so that substantially wear free pairing occurs.

The plungers 14 are of two part construction and consist of a portion or section 15 of metal which is disposed in the area of the drive housing and a section or portion 16 of solid ceramic which forms the actual displacement element. The two plunger sections 15, 16 are preferably adhered to one another. In order to further increase the reliability a corrugated retaining ring is preferably inserted into a recess of the metallic plunger part which additionally brings a degree of mechanical reliability to the connection of the two parts. The cross-section of the metal part at the drive side is larger than the cross-section of the ceramic part 16. In this way a reliable and comparatively large area guidance of the plunger part 15 in the associated sleeve 17 can be achieved, with the sleeve 17 preferably being formed in one piece with the housing 1. The plungers 14 are biased by means of a coil spring 20 against the ball bearing ring 13. I.e. the spring 20 ensures the return movement of the plunger 14. The spring 20 is braced between the housing 1 and a support ring which is secured by means of a ring to the plunger part 15.

A low pressure seal 18 is provided between the base wall 2 of the housing 1 and each of the plunger sections 15. The narrow space between the plunger section 15 and the guide sleeve 17 is connected with the inner space of the housing via bores 19.

The housing 1 is furthermore provided with at least one filler plug 21 and one drain plug 22 which are provided at the upper and lower sides of the housing 1 respectively. The drain plug 22 is magnetic or connected to a magnetic element so that metal particles which arise due to wear can be retained at this plug 22, so that an indication of the state of wear of the bearings is also achieved.

The housing 1 is very simple to manufacture because the guide bores for the plungers can be produced in one working step by means of a multi-spindle head and on the whole only a small amount of turning work is necessary.

The actual pump part 5 is axially clamped against the drive housing via threaded bolts 23.

Coaxially inserted support and guide sleeves are provided between the pump body 24 and the housing 1.

A first guide and distance sleeve 25 directly adjoins the base wall 2 of the housing and contacts the transmission seal 18. The larger diameter section 15 of the plunger 14 engages in this sleeve 25. The annular chamber which surrounds this plunger section is open to the outside via bores 26.

A further ring sleeve 27 which surrounds an inwardly disposed sleeve 28 which in turn accoomodates the high and low pressure seals 29, 30 is located between the sleeve 25 and the pump body 24. Radial passages 31 are formed between these seals 29, 30 and lead into an annular chamber 32 between the inwardly disposed sleeve 28 and the outwardly disposed sleeve 27. The annular chamber 32 is connected with the suction chamber 34 via bores 33. A further sleeve part 35 which bounds the pump chamber 36 at one end by its end face is arranged in the region of entry of the ceramic plunger 16 into the pump body 24. An inlet valve 37 and an outlet valve 38 are associated in the customary manner with each pump chamber.

The suction chamber 34 is disposed at the centre so that the connecton lines to the inlet valves can be symmetrically and identically constructed.

The suction chamber 34 is bounded by a closure plate 39 in which the suction connection 40 is formed. The plate 39 is clamped against the pump body 24 by means of the threaded bolts 23 which bring about the entire axial clamping of the coaxially assembled elements.

A peripherally extending pressure bore 41 connects with the high pressure outlets of the individual pump chambers 36.

FIG. 2 shows the symmetrical arrangement of the pump chambers relative to the central connection 40 and it can also be seen from FIG. 2 that the individual valves are easily accessible via the corresponding threaded plugs. An improvement in heat dissipation can be achieved by providing the housing 1 with ribs.

It is however important that a special cooling device can be used with the arrangement which makes it possible to extract heat from the drive chamber, and indeed using the medium which is being forwarded as the cooling medium. For this purpose a central tube 42 is provided in accordance with the embodiment illustrated in the drawing which extends from the suction chamber 34 up to the region of the ring 13 of the ball bearing 11 and which is closed in this end region. Seals are provided between this tube 42 and the base 2 of the housing and the pump body 24. The tube 42 is enlarged in generally conical manner in the suction chamber 34 and, as result of this shape, some of the medium being pumped flows into and out of the tube 42, i.e. through the tube 42 so that the desired cooling effect is obtained in the region of the drive housing. Any other suitable form of cooling device, through which a part of the forwarded medium must flow, can also be used in place of the tubular element 42. A flow of a proportion of approximately 10% of the forwarded medium through the cooling device can in most cases bring about the desired cooling effect.

Pumps in accordance with the invention are preferably provided with an odd number of plungers. It is important that the pumps can be driven at high speeds of rotation, for example 2800 revolutions per minute and more, and that drive powers of, for example, 4 to 5 kW can be straight-forwardly used without any form of temperature problems arising.

The connection flange of the drive housing is preferably constructed as a heat exchanger, for which purpose at least one copper tube can be inserted into this connection flange. In this way the advantage is achieved that heat generated by the drive motor is kept away from the transmission.

We claim:

1. A plunger pump comprising:
a housing;
an eccentric drive unit, including a drive shaft, mounted to the housing;
a plurality of pump chambers formed within the housing;
a plurality of plungers and plunger sleeves, associated with the pump chambers, mounted to the housing, the plungers' axes arranged parallel to the drive shaft, the plungers arranged in a circular grouping concentric with the drive shaft axis;
each plunger including a metallic plunger section disposed towards the eccentric drive and a ceramic section associated with the respective pump chamber, both sections being adhered with one another, the cross-section of the metallic section being larger than the cross-section of the ceramic section;
inlet valves fluidly connected to the pump chambers;
a suction chamber disposed centrally of the pump chambers and in fluid communication therewith through respective inlet valves;
generally radially disposed outlet valves, opening into a common annular pressure chamber, in fluid communication with the pump chambers;
first, second and third seals positioned in line along the plungers towards the eccentric drive and pump chambers respectively;
anti-contamination regions, fluidly connected to a region external of the pump through a bore, between the first and second seals surrounding the plungers to prevent contamination by fluid migration along the plunger; and
leakage return regions, fluidly connected to the suction chamber, between the second and third seals surrounding the plungers to permit a pumped fluid which leaks past the third seal to return to the suction chamber.

2. The plunger pump of claim 1 wherein:
the outlet valves are accessible from the outside via threaded plugs; and
the axes of the inlet and outlet valves extend at right angles to each other.

3. The plunger pump of claim 1 including a magnetic bearing closure means mounted to the housing.

4. The plunger pump of claim 1 wherein the housing includes a drive region surrounding the eccentric drive unit and a pump region at the pump chambers and suction chambers, the drive and pump regions physically separated so the pumped medium entering the suction chamber never contacts the eccentric drive.

5. The plunger pump of claim 1 wherein the housing includes a drive housing, within which the eccentric drive is housed, a pump body, containing the pump chambers, and a sleeve, housing at least a part of the plungers, the sleeve being mounted between the drive housing and pump body to physically separate the drive housing and pump body.

6. The plunger pump of claim 1 wherein the eccentric drive unit includes a swash plate mounted to the drive shaft and a bearing between the swash plate and the plungers.

7. The plunger pump of claim 6 wherein:
the plungers are spring biased toward the swash plate; and
the bearing includes a first race secured to the swash plate and a second race in sliding contact with ends of the plungers.

8. The plunger pump of claim 1 wherein the housing includes a drive housing, within which the eccentric drive is housed, and a pump body, containing the pump chambers.

9. The plunger pump of claim 8 further comprising a sleeve mounted between the drive housing and the pump body housing at least a portion of the ceramic plunger section.

10. The plunger pump of claim 9 further comprising:
a low pressure seal surrounding the metallic plunger part; and
a high pressure seal surrounding the ceramic plunger part.

11. The plunger pump of claim 9 wherein the pump body is biased against the housing via the sleeve by a plurality of symmetrically distributed threaded fasteners.

12. The plunger pump of claim 1 wherein:
the inlet valves are disposed coaxial to the plungers with each having the same spacing from the suction chamber; and
short leakage return passages provided between suction chamber and a region surrounding a portion of the plunger.

13. The plunger of claim 12 wherein the housing includes a drive housing and a pump body and further comprising a sleeve mounted between the drive housing and pump body housing at least a part of the plunger, the sleeve defining an annular region surrounding the plunger into which the short leakage return passage opens.

14. A plunger pump comprising:
a housing;
an eccentric drive unit, including a drive shaft, mounted to the housing;
a plurality of pump chambers formed within the housing;
a plurality of plungers and plunger sleeves, associated with the pump chambers, mounted to the housing, the plungers' axes arranged parallel to the drive shaft, the plungers arranged in a circular grouping concentric with the drive shaft axis;
inlet valves fluidly connected to the pump chambers;
a suction chamber disposed centrally of the pump chambers and in fluid communication therewith through respective inlet valves;

generally radially disposed outlet valves, opening into a common annular pressure chamber, in fluid communication with the pump chambers; and a cooling tube having an open end opening into the suction chamber and a closed end extending into a region adjacent the eccentric drive unit so the pump is cooled by the fluid being pumped.

15. The plunger pump of claim 14 wherein the housing includes a drive housing, within which the eccentric drive is housed, a pump body, containing the pump chambers, and a sleeve, housing at least a part of the plungers, the sleeve being mounted between the drive housing and pump body to physically separate the drive housing and pump body.

16. The plunger pump of claim 14 further comprising a first and second seals positioned along the plungers towards the eccentric drive and pump chambers respectively.

17. The plunger pump of claim 16 further comprising a bore formed in the housing connecting a region surrounding the plungers between the first and second seals to atmosphere to prevent contamination by fluid migration along the plunger.

18. The plunger pump of claim 17 further comprising:

third seals positioned along the plungers between the second seals and the pump chambers;

leakage return passages connecting regions adjacent the plungers between the second and third seals with the suction chamber.

19. A plunger pump comprising:

a drive shaft having an axis;

a swash plate;

means keying said swash plate to said drive shaft;

a plurality of plungers arranged in a circular array and each having a drive end, a pumping end and an axis of reciprocation, with said axes of reciprocation lying parallel to one another and with said array being concentric to said drive shaft;

a ball thrust bearing having first and second races, with said first race being mounted on said swash plate and with said second race engaging with said drive ends of said plungers to produce reciprocation of the same on rotation of said swash plate;

a drive housing surrounding said swash plate and said drive ends of said plungers, said drive housing having a transverse wall with openings for said plungers and defining a mounting surface;

a pump head;

a circular array of pump chambers formed in said pump head for accommodating the pumping ends of said plungers;

means for mounting said pump head on said drive housing;

a suction chamber substantially centrally disposed in said pump head, and having an opening at a side of said pump head remote from said drive housing;

a plate closing said opening and having a centrally disposed inlet connection;

a respective inlet valve associated with each pump chamber;

respective bores in said pump head forming extensions of said pump chambers for receiving said inlet valves;

inlet passages leading from said centrally disposed suction chamber to said inlet valves, with each said inlet valve being substantially the same distance from said suction chamber;

a respective outlet valve associated with each said pump chamber;

respective radial bores in said pump head extending radially away from said pump chambers for accommodating said outlet valves; and said means for mounting said pump head on said drive housing including:

a respective sleeve arrangement surrounding each said plunger and acting as a distance piece between said drive housing and said pump head; and a plurality of symmetrically distributed threaded fasteners extending through said plate into said drive housing for clamping said plate against said pump head and said pump head against said sleeve arrangements, each said sleeve arrangement including means for accommodating seals for said pump ends of said plungers.

* * * * *